United States Patent [19]

Speicher

[11] Patent Number: 4,652,156

[45] Date of Patent: Mar. 24, 1987

[54] PROGRAMMABLE MARKING MACHINE

[75] Inventor: Edwin W. Speicher, Pittsburgh, Pa.

[73] Assignee: M. E. Cunningham Company, Ingomar, Pa.

[21] Appl. No.: 793,797

[22] Filed: Nov. 1, 1985

Related U.S. Application Data

[62] Division of Ser. No. 642,129, Aug. 17, 1984, Pat. No. 4,591,279.

[51] Int. Cl.[4] ..... B41J 3/10

[52] U.S. Cl. ..... 400/121

[58] Field of Search ..... 400/121, 124, 48, 31; 411/480, 923

[56] References Cited

U.S. PATENT DOCUMENTS

| | | | |
|---|---|---|---|
| 975,310 | 11/1910 | Ybarrondo | 411/923 X |
| 2,667,956 | 2/1954 | Sundstrand et al. | 400/31 |
| 3,226,530 | 12/1965 | Greenblott et al. | 400/121 X |
| 3,911,812 | 10/1975 | Flynn et al. | 400/121 X |
| 4,051,940 | 10/1977 | Kuelzer | 400/124 |
| 4,304,495 | 12/1981 | Wada et al. | 400/124 |
| 4,506,999 | 3/1985 | Robertson | 400/121 |

FOREIGN PATENT DOCUMENTS

| | | | |
|---|---|---|---|
| 556989 | 4/1923 | France | 411/480 |
| 21868 | 2/1981 | Japan | 400/124 |
| 185534 | 9/1922 | United Kingdom | 411/480 |

*Primary Examiner*—Clifford D. Crowder
*Attorney, Agent, or Firm*—Stanley J. Price, Jr.

[57] ABSTRACT

A portable frame is supported for vertical movement on a pair of posts adjacent the surface of a table for receiving an object to be marked. A traveling plate is supported for movement on the frame in the horizontal plane above the surface of the object on the table. A ball screw drive connects the traveling plate to the frame for imparting longitudinal movement of the traveling plate in the horizontal plane. A marking head assembly is pivotally mounted on the plate and carries a plurality of impact pins which are reciprocated into and out of contact with the object by operation of programmable solenoid valves. An indexing wheel adjusts the angular position of the marking head assembly to control the size of characters formed by the pins impacting the object. The pins are activated as the traveling table is moved in the horizontal plane to inscribe a desired mark of a preselected character size on the plate. The object is also movable relative to the marking head assembly to facilitate multiple line marking in both forward and reverse directions of travel of the plate.

7 Claims, 20 Drawing Figures

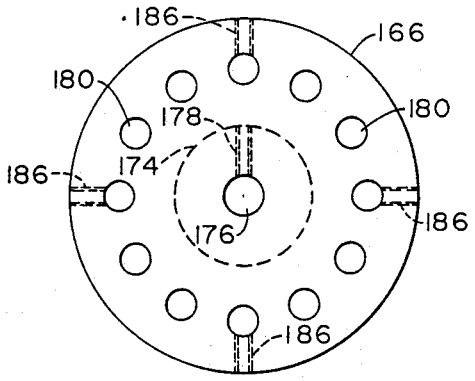
FIG.7
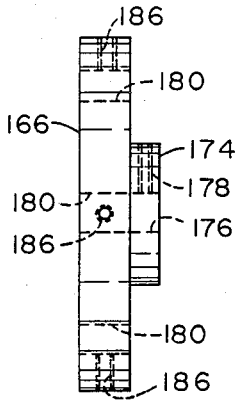
FIG.8
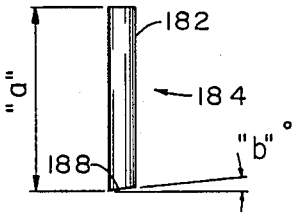
FIG.9
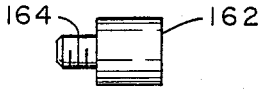
FIG.10
| "a" | "b" | CHAR. SIZE |
|---|---|---|
| 1 1/8" | 7°40' | 1/2" |
| 1 3/16" | 6°40' | 7/16" |
| 1 1/4" | 5°45' | 3/8" |
| 1 5/16" | 4°45° | 5/16" |
| 1 11/32" | 3°50' | 1/4" |
| 1 13/32" | 2°55' | 3/16" |
| 1 15/32" | 2°0' | 1/8" |
| 1 1/2" | 1°30' | 3/32" |
FIG.11

PROGRAMMABLE MARKING MACHINE

CROSS REFERENCE TO RELATED APPLICATIONS

The application is a divisional of copending application Ser. No. 642,129, filed on Aug. 17, 1984, now U.S. Pat. No. 4,591,279 entitled, "Programmable Marking Machine" by Edwin W. Speicher.

BACKGROUND OF THE INVENTION

1. Field of the Invention

This invention relates to apparatus for marking a workpiece and, more particularly, to a method and apparatus for supporting a marking device for selective movement on a frame to position the marking device to selectively impress identification marks on the surface of the workpiece.

2. Description of the Prior Art

Impact type marking devices are well known in the art of impressing identification marks on the surface of stock being conveyed in a production line. One well known application is the use of marking machines that carry marking elements, either alpha or numeric characters, into impact relation with the surface of a workpiece to impress an array of characters on the workpiece as it is being conveyed in a production line. The devices disclosed in U.S. Pat. Nos. 3,541,954; 3,636,871 and 4,036,127 are representative of these types of marking machines which are used to impress identification marks on the surface of stock material, such as billets, slabs, plates, bars, ingots, and the like.

In the past, it has been the practice to utilize a single wheel marker that includes a plurality of marking elements or characters carried on the peripheral surface of the marking wheel. Such an arrangement is disclosed in U.S. Pat. No. 4,214,520. This type of marking device can be utilized to mark a wide variety of objects that vary in size from rolling stock in a production line to various metals, tags, components and parts.

It is also known to remotely control the operation of a single or multiple wheel marking machine to rotate the marking wheel to place a desired character in position for impressing a mark on the surface of the object. The wheel is mounted in a frame which is capable of moving through various degrees of movement and to be locked in the desired location. Thereafter, an actuator, upon energization, moves the marking wheel to strike the workpiece and impress the selected mark on the surface thereof. The marking wheel is retracted, after which the wheels incrementally rotate and move laterally to the next position for marking the workpiece. Thus the actuator is sequentially operated to move the marking wheel along a preselected path to impress the desired series of characters on the workpiece. The principal disadvantage to this type of marking device is that the choice of characters available for impressing a mark on the surface of the workpiece is limited by the characters carried on the periphery of the marking wheel. Also, depending upon the position of the characters on the marking wheel, delays are encountered in retracting the marking wheel and rotating the marking wheel to position the desired character in marking relation with the workpiece.

Therefore, the conventionally known single and multiple wheel type marking machines are not readily adaptable to rapid marking operations where a wide variety and combination alphanumeric characters are required to be impressed upon the surface of an object. The need for providing a rapid marking operation is particularly important in a production line where the marking device must be supported for rapid movement into and out of marking position and the character selection is also rapidly accomplished. Of principal importance is that the marking characters be rapidly changed on the marking device to permit marking a plurality of workpieces moving in rapid succession in a production line without interrupting the sequence of operations which take place in a production line due to delays encountered with the marking operation.

More recently, in an effort to increase the speed of the marking operation and to reduce the time required to change the combination of the alphanumeric characters for a message to be inscribed on a workpiece, noncontact markers, such as ink jet or spray printers, as well as dot matrix engraving machines have been utilized. Ink jet or spray printers are predominantly used to imprint on recording medium, such as paper. Examples of known ink jet or spray markers are disclosed in U.S. Pat. Nos. 3,787,884; 4,272,773; 4,356,499; 4,376,284; 4,412,232 and 4,415,909.

Programmable dot matrix printers are well known, such as is disclosed in U.S. Pat. No. 4,412,232. U.S. Pat. No. 4,415,909 discloses an ink jet printer which includes a print head movably supported along a line of print with the line of symmetry of the printhead being at an angle relative to the direction of motion. This arrangement produces a vertical column of dots perpendicular to the direction of movement. A nozzle array is formed in a pattern to generate equally separated rows of dots on the recording media. A drive element is associated with each nozzle, and a piezoelectric crystal initiates the formation of ink droplets which are ejected from the nozzle. The times for energizing the individual print elements are remotely controlled to minimize the gap between the nozzles in forming dot matrix type printing. U.S. Pat. No. 3,892,174 discloses a spray marking device operable to apply a dot matrix mark to an object moving along a conveyor. It is stated that the dots may also be represented by an impact mark. Electrical controls are provided to select the desired alphanumeric characters and to control movement of the object to be marked.

British Pat. No. 2,002,694 discloses a programmable dot matrix type of engraver for impressing a selected size of alphanumeric characters on a workpiece. The engraver is computer controlled to provide selective continuous marking of the workpiece to overcome the delays encountered with manual engravers. An engraving tool is supported on an arm which is movable on a carriage by a leadscrew rotated by a stepping motor. The carriage is movably mounted on a horizontal arm that is, in turn, supported by a vertical column above a base on which the workpiece to be marked is stationarily positioned. With this arrangement, the engraving tool is movable along horizontal X and Y axes. The engraving tool includes a punch which is remotely controlled by a central processing unit through a solenoid operated air valve to form the desired dot matrix character whereby the size of the figure engraved is determined by the number of stepping motor steps between each point of the $7\times5$ matrix. Furthermore, similar to the wire dot martix printers for computers, there is now also available an engraver with marking pins selectively actuated and arranged in a straight line configuration, which can form alphanumeric characters by collectively traversing a given number of lateral units. U.S. Pat. No. 4,506,999 entitled "Program Controlled Pin Matrix Embossing Apparatus" discloses pneumatically controlled apparatus that includes an array of pins utilized to emboss alphanumeric characters in an object. Seven pins move across the object and selectively mark the object with the desired characters. The angular arrangement of the pins determines the height of the characters and rotation of the head adjusts the angle of the line of pins. The angular adjustment is made manually by means of ball lock pins.

While it has been suggested by the prior art devices to utilize both contact and noncontact type dot matrix marking devices, there is need for an improved dot matrix type marking device that is computer controlled to rapidly mark the workpiece with a preselected alpha or numeric character and also a message that includes a combination of alphanumeric characters. The marking operation must be accomplished, particularly in a production line type of operation, without interfering with the other operations performed on the workpiece in the production line. The marking device must be capable of movement along multiple paths in a plurality of axes to enable selective positioning of the mark to be impressed on the surface of the workpiece. There is also need for a dot matrix type marking device for inscribing multiple lines of dot matrix characters on the surface of an object in rapid fashion and remotely controlling the size and the size change of the characters.

SUMMARY OF THE INVENTION

In accordance with the present invention there is provided apparatus for supporting a marking device for movement into position for marking the surface of an object that includes a fixed base for supporting an object to be marked. A support frame is mounted on the fixed base. A plate is positioned on the support frame for movement in a horizontal plane of travel above the objects supported by the fixed base. Drive means is drivingly connected to the plate for moving the plate in a preselected direction in a horizontal plane on the support frame. Guide means connected to the plate maintains movement of the plate along a preselected direction of travel in a horizontal plane relative to the support frame. A marking device is carried by the plate. Means is provided for connecting the marking device to the plate to generate a mark on the object upon movement of the plate in a horizontal plane.

Further in accordance with the present invention there is provided apparatus for impressing a preselected mark on the surface of an object that includes a marking head having a body portion. The body portion includes a spaced apart arrangement of bores extending therethrough. The body portion includes a first surface and a second surface positioned oppositely of the first surface. The bores extend through the first and second surfaces. A marking element is reciprocally positioned in each of the bores. Each of the marking elements includes a shaft portion with an impact end portion movable into and out of the respective bore from the body portion first surface to impress a mark on the surface of an object. A marking element has an opposite end portion positioned in the bore adjacent the body portion second surface. A manifold block is positioned in abutting relation with the marking head body portion second surface. Means is provided for releasably connecting the manifold block to the marking head body portion. Actuating means carried by the manifold block and communicating with each of the marking elements sequentially reciprocates the marking elements in the bores in a controlled manner to impact the object and impress a preselected mark on the surface of the object.

Additionally in accordance with the present invention there is provided an impact marking tool that includes a pin member. The pin member has an elongated body portion with a striking end portion and an opposite end portion. A bushing has a bore therethrough for receiving the pin member opposite end portion. Means is provided for positioning the pin member opposite end portion at a preselected location within the bushing bore to locate the pin striking end portion a preselected distance from the bushing. Means is provided for releasably connecting the bushing to the pin member opposite end portion.

Further in accordance with the present invention there is provided a table assembly for movably supporting an object to be marked that includes a stationary base plate. A frame is secured to and extends upwardly from the stationary base plate. The frame includes spaced apart support members having an upper surface positioned in a horizontal plane. A traveling plate is positioned for movement in said horizontal plane on said support member's upper surface. Guide means on the frame engages the traveling plate to maintain the traveling plate movable along a path of travel in said horizontal plane on said support members upper surface. Drive means is supported by the frame and is connected to the traveling plate for moving the traveling plate in a preselected direction along said path of travel in said horizontal plane.

Accordingly, the principal object of the present invention is to provide marking apparatus for movably supporting a marking device in a horizontal plane of travel to form a selected array of characters of a preselected size.

Another object of the present invention is to provide a marking head assembly that includes a body portion for reciprocally retaining a plurality of impact pins operable to extend and retract by the application of air under pressure from the manifold releasably connected to the body portion.

An additional object of the present invention is to provide a marking head assembly that is pivotally mounted on a frame whereby the angular orientation of the assembly controls the size of characters formed by the assembly as it is advanced at a preselected rate in a horizontal plane above an object to be marked.

Another object of the present invention is to provide an impact marking tool formed by a plurality of components that permit adjustments to be made in the size of the components and facilitate efficient repair by replacement of damaged components obviating the need to replace the entire marking tool.

These and other objects of the present invention will be more completely disclosed and described in the following specification, the accompanying drawings, and the appended claims.

BRIEF DESCRIPTION OF THE DRAWINGS

FIG. 7 is a view in side elevation of an indexing wheel for controlling the angular position of the marking head assembly on the machine.

FIG. 8 is an end view of the indexing wheel shown in FIG. 7.

FIG. 9 is an elevational view of a representative stop pin mounted on the indexing wheel shown in FIG. 7.

FIG. 10 is a view in side elevation of a stop plug that is mounted on the marking head assembly for engagement by a stop pin of the indexing wheel to position the marking head in the desired angle of orientation to control the height of the dot matrix characters imprinted on the workpiece.

FIG. 11 is a chart identifying the relationship between the size of the dot matrix characters and the dimensions of the stop pin.

DESCRIPTION OF THE PREFERRED EMBODIMENTS

Figure 1:
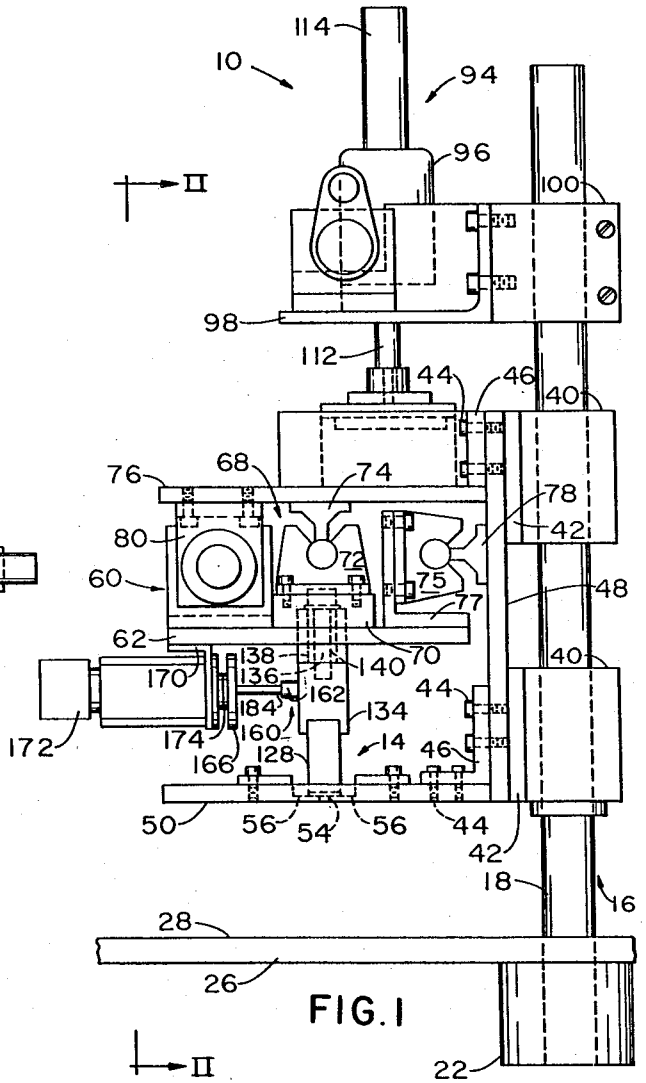
FIG. 1 is view in side elevation of a marking machine, illustrating a marking head assembly supported on a base of the machine in vertical position for selective movement for impressing identification marks on a workpiece.
Figure 2:
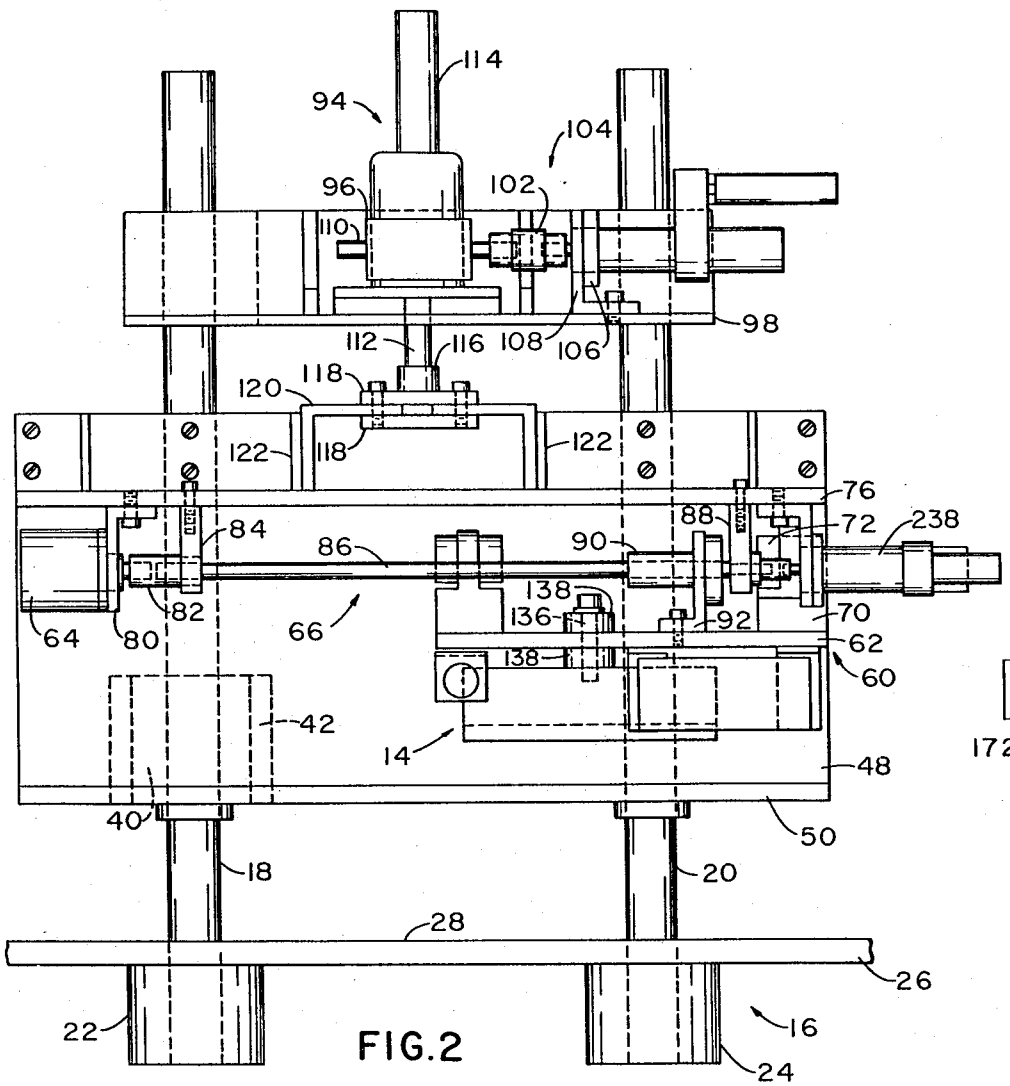
FIG. 2 is an elevational view taken along line II—II of FIG. 1, illustrating the arrangement for moving the marking head assembly in a plurality of directions.

Referring to the drawings and particularly to FIGS. 1—6 there is illustrated marking apparatus generally designated by the numeral 10 in FIGS. 1 and 2, and marking apparatus generally designated by the numeral 12 in FIGS. 3-6 for supporting a marking device 14 for movement into and out of position for marking the surface of a workpiece and for moving the marking device 14 during the marking operation. Both marking apparatus 10 and 12 are adaptable for impressing by the marking device 14 a preselected array of characters including but not limited to alphanumeric characters on many types of workpieces that include production line items, such as slabs, rolled stock and the like, as well as plates, round and various tags, components and parts fabricated of material which may be comprised of glass, metal or plastic.

As seen in FIGS. 1 and 2, the marking apparatus 10 is mounted for vertical movement on a support system generally designated by the numeral 16 that includes a pair of spaced apart, vertically extending posts 18 and 20 which are supported by pedestals 22 and 24 below a horizontal supporting structure, such as a conveyor, table, or platform 26. The platform 26 has an upper surface 28 for supporting the workpiece which can either be retained in a fixed position on the platform 26 or moved on the platform 26, as will be explained later in greater detail. With this arrangement, the marking device 14 is positioned vertically above the platform 26, and the workpiece is positioned on the platform surface 28.

Figure 3:
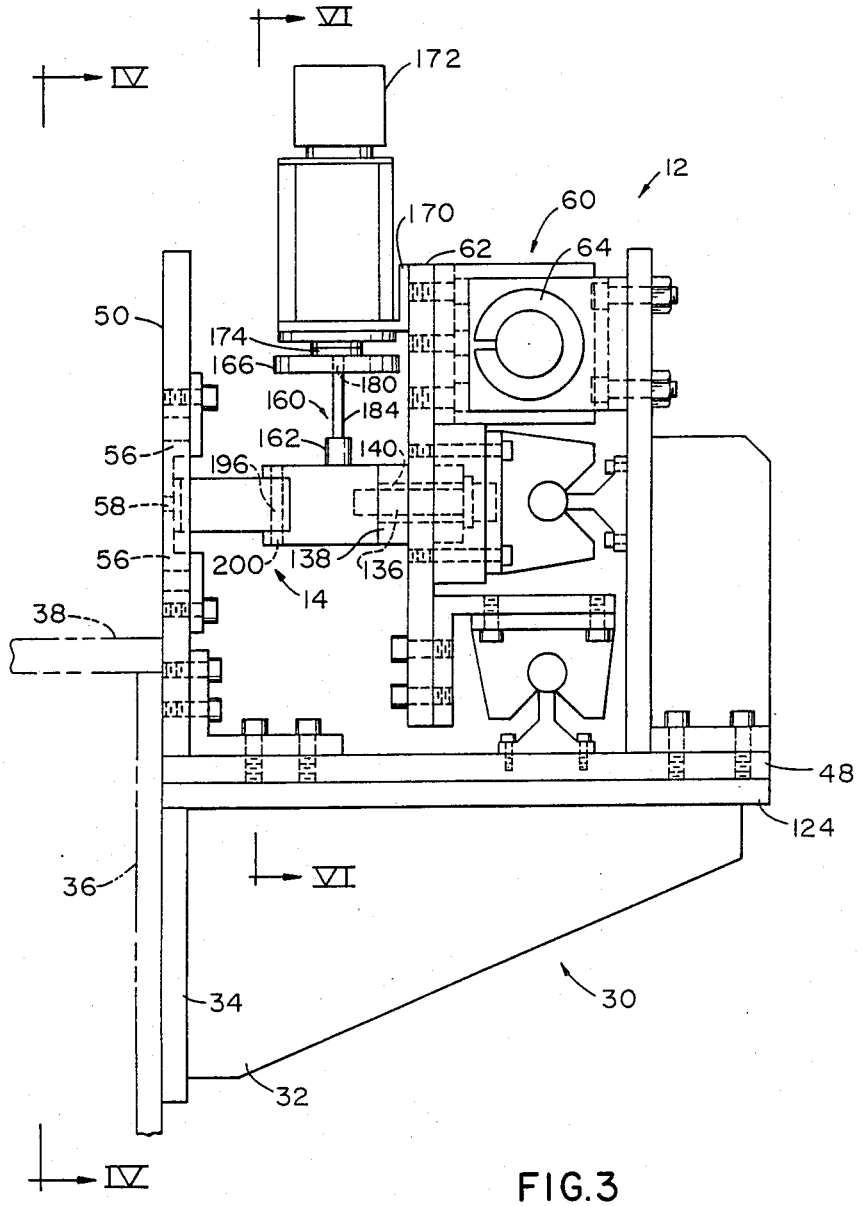
FIG. 3 is a view in side elevation of another embodiment of the marking machine, illustrating a marking head assembly horizontally supported for impressing identification marks on a workpiece.

The marking apparatus 12 illustrated in FIG. 3 corresponds substantially to the marking apparatus 10 shown in FIGS. 1 and 2 in which the apparatus 12 is supported in a manner to position the marking device 14 in a horizontal plane. Accordingly, like numerals used to identify the elements of the marking apparatus 10 in FIGS. 1 and 2 will be used to designate like elements for the marking apparatus 12 shown in FIGS. 3-6. As shown in FIG. 3, the marking apparatus 12 is mounted on a support system, generally designated by the numeral 30 that includes an angle mounting bracket 32 having a vertically positioned base plate 34 suitably connected, as by bolting, to the side of table 36 (shown in phantom) in FIG. 3. The table 36 includes a horizontal surface 38 for supporting the workpiece as it is being marked.

Now referring in greater detail to the marking apparatus 10 shown in FIGS. 1 and 2, the support system 16 includes a plurality of bearing supports, such as pillow block bearings 40. Each post 18 and 20 has a pair of pillow block bearings 40 secured thereon in spaced vertical arrangement. FIG. 1 illustrates the pair of pillow block bearings 40 on the post 18. A corresponding pair of pillow block bearings 40 are also provided on the post 20; however it should be understood that the pillow block bearings have beem omitted from the post 20 in FIG. 2 for clarity of illustration of the other elements.

Each pillow block bearing 40 includes a flange portion 42 that is secured by bolts 44 to a bracket 46 that abuts against intermediate plate 48. A base plate 50 is positioned horizontally relative to the vertical intermediate plate 48 and is also secured by bolts 44 to the bracket 46 on the lower pair of pillow block bearings 40. The base plate 50, which is shown in greater detail in FIG. 4, includes a longitudinally extending opening 52 through which the marking elements of the marking device 14 are extensible and retractable to impress an identification mark on the surface of the workpiece positioned on the platform surface 28.

Figure 16:
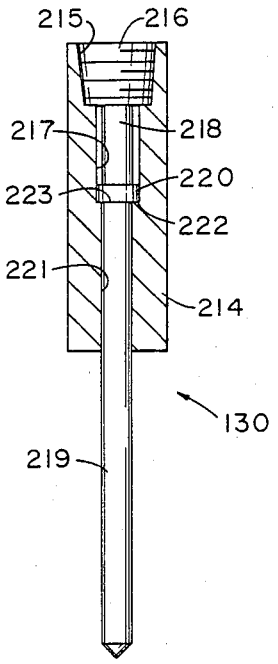
FIG. 16 is an enlarged view, partially in section, of one embodiment of a marking pin for the marking head assembly.
Figure 17:
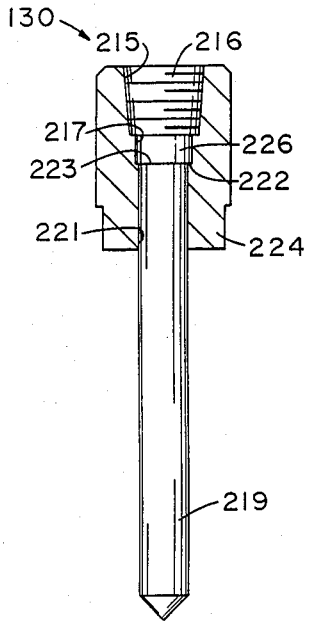
FIG. 17 is a view similar to FIG. 16, illustrating another embodiment of a marking pin.
Figure 15:
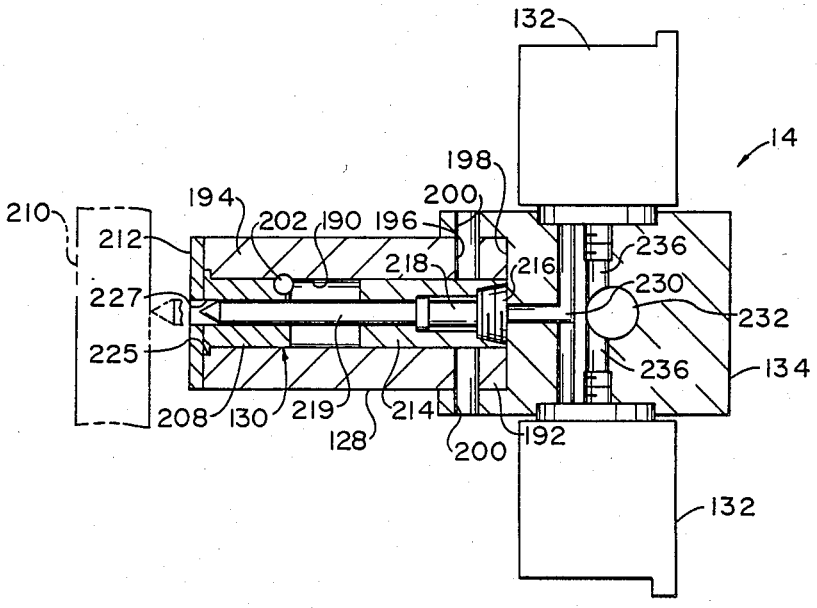
FIG. 15 is a schematic illustration, partially in section, of the marking head assembly taken along lines XV—XV of FIG. 13, illustrating the fluid connection between a marking pin and associated solenoid valve for extending and retracting the pin into and out of engagement with the surface of the workpiece to impress a dot on the workpiece.

The marking elements within the marking device 14 can include in one embodiment, as shown in detail in FIGS. 15–17, pin members that are reciprocally carried by the marking device 14 and are remotely controlled, such as by a computer, to extend and retract in a selected manner to inscribe a preselected array of programmed characters on the surface of the workpiece.

Associated with the opening 52 in the base plate 50 is an optional pair of guide plates 56 which are bolted to the base plate 50. The guide plate 56 can also be used with the embodiment of the apparatus 12 shown in FIGS. 3 and 4 where the plates 56 are shown spaced apart to provide a slot 58 through which the marking elements extend. However, it should be understood that the guide plates 56 are not utilized when the characters to be marked are of a size that require the marking device 14 to be tilted to a preselected angle, which will be explained later in greater detail.

As shown in FIG. 1, the marking device 14 is mounted on a carriage assembly 60 which is positioned for reciprocal movement in a horizontal plane above the platform 26. The carriage assembly 60 includes a traveling plate 62 for supporting the marking device 14. A motor 64, shown in FIG. 2, is connected by a ball screw drive mechanism generally designated by the numeral 66 to the plate 62 for rectilinearly moving the plate 62 in a horizontal plane above the surface 28 of the platform 26. The ball screw drive mechanism 66 will be described later in greater detail.

The plate 62 and therefore the carriage 60 are supported for horizontal, reciprocal movement by the provision of a guide mechanism generally designated by the numeral 68 in FIG. 1. The guide mechanism 68 includes a spacer 70 that is fixedly secured, such as by bolting, to the upper surface of the plate 62. A sliding bed 72 is positioned on and bolted to the spacer 70. The sliding bed 72 includes a groove for receiving a guide shaft 74 which is mounted on horizontal support plate 76 which is, in turn, connected to the intermediate plate 48 of the support system 16 which is vertically movable as above discussed on the posts 18 and 20. The intermediate plate 48, base plate 50, and horizontal plate 76 for a generally U-shaped support member for the marking device 14.

A second sliding bed 75 is connected to a bracket 77 also mounted on the plate 62. The sliding bed 75 includes a groove for receiving a guide shaft 78 that is connected to the vertical intermediate plate 48. With this arrangement the plate 62 is stabilized by movement of the sliding beds 72 and 75 on the fixed guide shafts 74 and 78, respectively.

Movement of the carriage assembly 60 on the guide mechanism 68 is accomplished by actuation of the motor 64. The motor 64 can be operated by various means, such as electrically or pneumatically, and is supported on a bracket 80 which is bolted to the support plate 76 of the support system 16, as seen in FIGS. 1 and 2. The motor 64 is drivingly connected to a coupling 82 which is drivingly connected through a shaft seal 84 to one end of a ball screw 86. The opposite end of the ball screw 86 is rotatably supported by a second shaft seal 88. Both shaft seals 86 and 88 are connected to the support plate 76.

A ball screw guide 90 is connected to the traveling plate 62 by a bracket 92. The ball screw guide 90 drivingly engages the ball screw 86. Upon rotation of the ball screw 86 by actuation of the motor 64, the ball screw guide 90 moves longitudinally on the ball screw 86 between the shaft seals 84 and 88. Consequently, as the ball screw guide 90 moves, the carriage assembly 60 and specifically the traveling plate 62 moves in a horizontal plane parallel to the ball screw 86. In this manner, the marking device 14 moves in a horizontal plane parallel to platform surface 28.

The marking device 14 illustrated in FIG. 1 is movable in a horizontal plane above the platform 26, as well as vertically to a desired position on the posts 18 and 20. Vertical movement of the marking device 14 may be accomplished manually by the use of conventional clamps to secure the pillow block bearings 40 in the desired position on the posts 18 and 20, or by a powered jack generally designated by the numeral 94 in FIGS. 1 and 2. The powered jack 94 includes a suitable motor 96 which can be either air or electrically operated, and is supported by a mounting bracket 98 to a pair of clamp blocks 100 (only one of which is shown) in FIG. 1. Clamp blocks 100 are rigidly secured in a fixed position on the upper end of the posts 18 and 20. Thus with this arrangement the motor 96 is maintained in a fixed position for operation.

The motor 96 is drivingly connected as shown in FIG. 2 to a coupling 102 which is, in turn, connected to an inverted-type ball screw drive, generally designated by the numeral 104 that is supported by a ball bearing block 106 to an angle bracket 108 mounted on the mounting bracket 98. The ball screw drive 104 includes a ball screw 110 that is drivingly connected to a shaft 112 mounted in a housing 114 which is secured to the motor 96. The shaft 112 includes a lower end portion 116 which is secured by a pair of spacer plates 118 to a jack mounting angle 120. The jack mounting angle is, in turn, suitably connected, such as by bolts, not shown, to a pair of spaced apart plates 122 that extend outwardly from the intermediate plate 48. With this arrangement, upon rotation of the ball screw 110 by actuation of the motor 96, the shaft 112 moves longitudinally at a right angle with respect to the ball screw 110. In this manner the shaft 112 is extended and retracted from housing 114 relative to the mounting bracket 98 fixed on the posts 18 and 20.

Rotation of the ball screw 110 in a preselected direction extends the shaft 112 from the housing 114 to lower the carriage assembly 60 with the marking device thereon toward the surface 28 of the platform 26. Accordingly, rotation of the ball screw 110 in the opposite direction retracts the shaft 112 into the housing 114 which, in turn, raises the carriage assembly 60 and the marking device 14 to a selected height above the platform 26.

Figure 4:
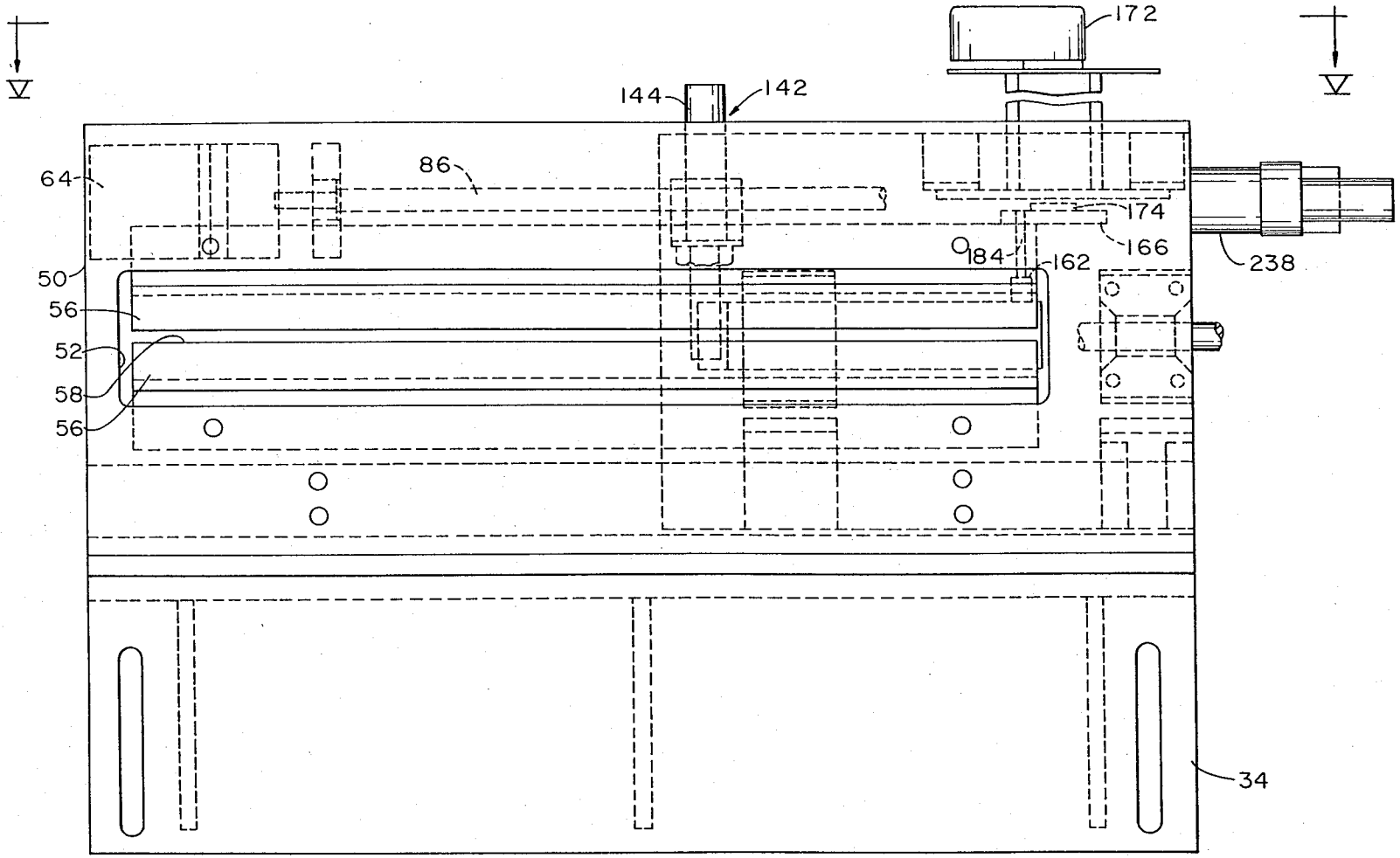
FIG. 4 is a view of the marking machine taken along line IV—IV of FIG. 3.
Figure 5:
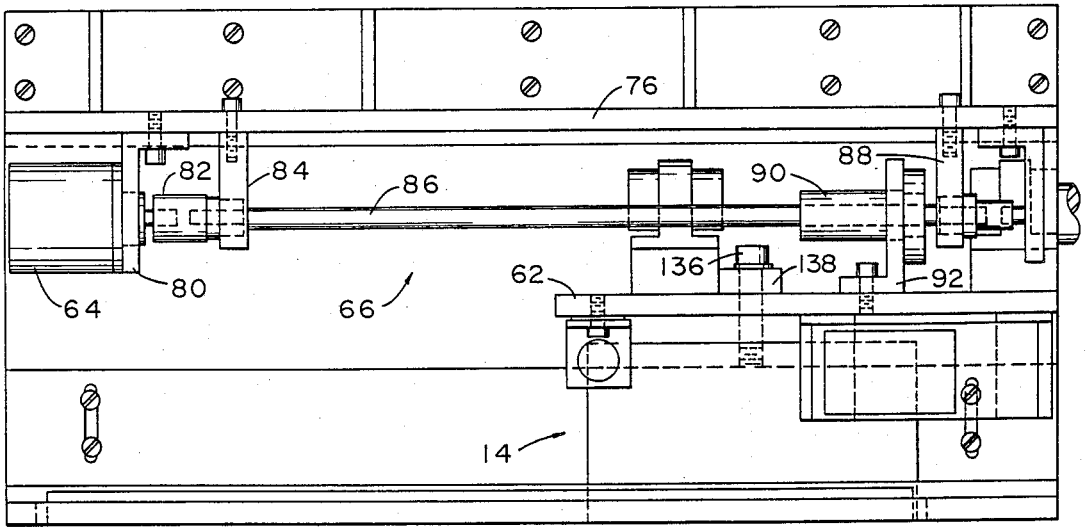
FIG. 5, which is on the sheet of drawings with FIGS. 16 and 17, is a view of the marking machine taken along line V—V of FIG. 4.

With regard to the embodiment of the marking apparatus 12 illustrated in FIGS. 3, 4 and 5, the substantially same elements discussed above with regard to the marking apparatus 10 illustrated in FIGS. 1 and 2 are utilized with the marking apparatus 12. The marking apparatus 12, as above discussed, is mounted on the table 36 in position where the marking device 14 lies in a horizontal plane above the table surface 38. Accordingly, to modify the above described marking apparatus 10 for use in the orientation of the apparatus 12 illustrated in FIG. 3, the intermediate plate 48 is removed from its connection to the pillow block bearings 40 and is bolted to a horizontally positioned plate 124 of the support system 30. The marking apparatus 12 also includes the carriage assembly 60 and plate 62 supported by the guide shafts 74 and 78 for movement of the marking device 14 in a horizontal plane. The marking apparatus also uses a ball screw drive, as above described. As seen in detail in FIG. 4, the marking device 14 is positioned oppositely of the opening 52 in the base plate 50 to provide a wide range of horizontal movement of the marking device 14 within the longitudinal dimension of the base plate opening 52.

Figure 6:
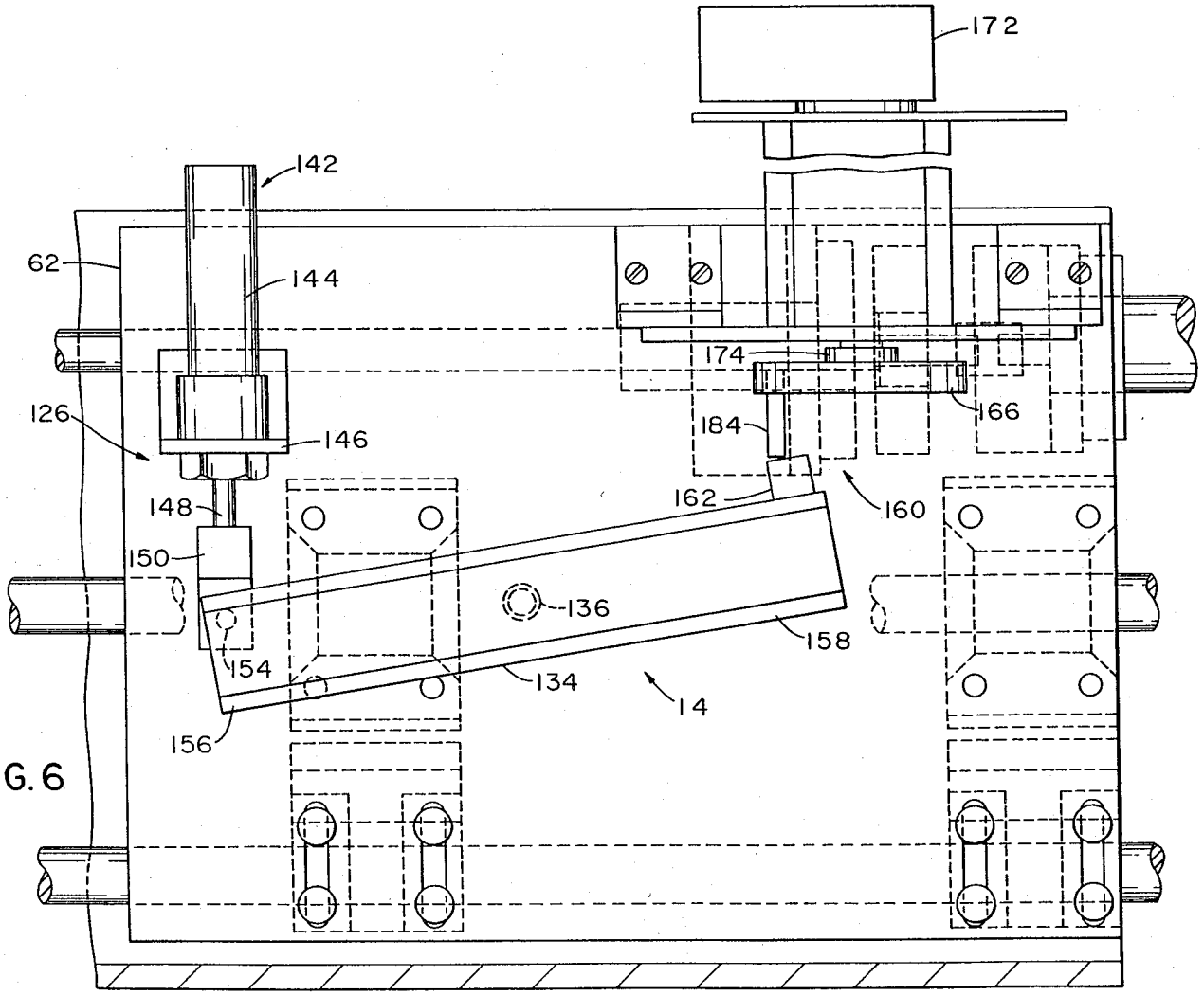
FIG. 6 is another view of the marking machine taken along line VI—VI of FIG. 3.

Further in accordance with the present invention, both marking apparatus 10 and 12 are provided with a pivoting mechanism, generally designated by the numeral 126 and shown in detail in FIG. 6, and with selected components of the tilting mechanism shown in FIGS. 7–10. The pivoting mechanism 126 is operable to adjust and maintain the marking device 14 in a preselected angular position with respect to intermediate plate 48. With this arrangement, the marking device 14 is pivoted or tilted to a preselected angle which determines the height of the characters formed on the workpiece by the marking device 14.

Figure 12:
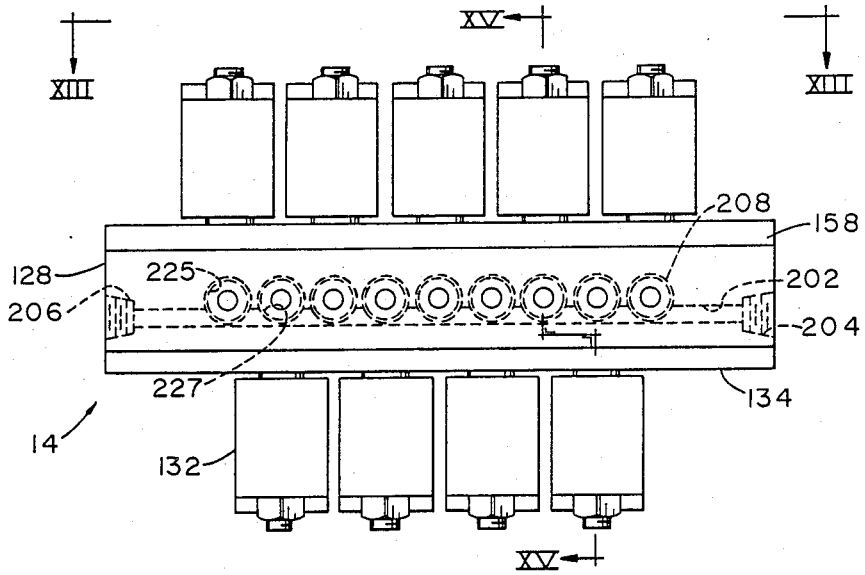
FIG. 12 is a top plan view of a manifold and a plurality of air operated solenoid valves mounted on the marking head assembly for controlling operation of the marking pins.

As will be explained later in greater detail and illustrated in FIGS. 13–17, the marking device 14 includes a marking head body portion 128 that includes a plurality of marking elements in the form of impact pins, generally designated by the numeral 130, which will be discussed later in greater detail. The impact pins 130 are reciprocally movable in the marking head body portion 128. The plurality of impact pins 130, for example nine, are positioned in the head body portion 128 and spaced in longitudinal alignment. Each pin 130 is associated with one of a plurality of air operated solenoid valves 132 as shown in FIG. 12. The solenoid valves 132 are operable to extend and retract the impact pins 130 to indent the surface of a workpiece with dots to form a single-line dot matrix array of characters, figures, or patterns. Actuation of the solenoid valves 132 to form the desired mark is programmable and controlled from a central processing unit (not shown).

The solenoid valves 132 are mounted on a manifold block 134 which is connected, as illustrated in FIG. 15, to one end of the marking head body portion 128. As illustrated in FIGS. 1–3 and 6, the manifold block 134 is pivotally connected to the plate 62 in a manner that permits the entire marking device 14 to be pivoted, for example about a vertical axis for the marking apparatus 10 illustrated in FIG. 2 or about a horizontal axis for the marking device illustrated in FIGS. 3 and 6.

The pivotal mounting of the marking device 14 is accomplished by securing the upper end portion of the manifold block 134 to a pivot pin 136 having a lower end portion which is threaded into a threaded bore of the manifold block 134. The pivot pin 134 is mounted within a pair of thrust bearings 138 which are positioned on opposite sides of the plate 62. A sleeve 140 shown in FIGS. 1 and 3 extends through aligned bores of the thrust bearings 138. The pivot pin 136, in turn, extends through the sleeve 140 into threaded engagement with the manifold block 134. With this arrangement, the pin 136 is pivotal within the bearings 138, and pivotal movement of the pin 136 is transmitted to the manifold block 134 to move the block 134 with the pin 136.

The manifold block 134, together with the marking head body 128, are pivotable to a preselected angle by operation of a piston cylinder assembly generally designated by the numeral 142 in FIGS. 4 and 6. The piston cylinder assembly 142 includes a cylinder portion 144 mounted by a bracket 146 to the bottom surface of the movable plate 62. A cylinder rod 148 is extensible relative to the cylinder 144 and includes a rod end portion 150. The rod end portion 150 has extending through it a bore 154, as shown in FIG. 6.

As further illustrated in FIG. 6, the manifold block 134 includes opposite end portions 156 and 158. The rod end portion 150 is suitably connected to the manifold block end portion 156. In one manner of connection, the block end portion 156 is provided with a slotted opening (not shown) and suitable means, such as a pin, is rotatably supported in the block end portion 156 and extends through the bore 154. With this arrangement, upon actuation of the piston cylinder assembly 142 to extend or retract the cylinder rod 148, the manifold block 134 pivots about the pivot pin 136.

The manifold block 134 is pivoted to a preselected angular position on the plate 62 about the pivot pin 136 upon actuation of the piston cylinder assembly 142. A stop mechanism generally designated by the numeral 160 in FIGS. 1, 3 and 6 holds the selected pivot position of the block 134. The stop mechanism 160 includes a stop plug 162 shown in detail in FIG. 10. The stop plug 162 includes a threaded shaft 164 which is threaded into a bore in the end portion 158 of the manifold block 134.

Positioned oppositely of the manifold block end portion 158 is an indexing wheel 166 illustrated in FIG. 6 and in further detail in FIGS. 7 and 8. The wheel 166 is rotatably mounted on angle bracket 170 that is bolted to the lower surface of the plate 62. The indexing wheel 166 is drivingly connected to the shaft of an indexing motor 172. The indexing wheel 166 as shown in FIG. 8 includes a hub portion 174 having a bore 176 for receiving the shaft of the indexing motor 172. A set screw is adapted to extend through a bore 178 of the hub portion 174 into engagement with the motor shaft to nonrotatably connect the shaft of the motor to the wheel hub portion 174. In this manner, actuation of the motor 172 rotates the indexing wheel 166.

As illustrated in FIG. 7, the wheel 166 includes a circular array of bores 180 that extend through the wheel 166. The bores 180 are spaced a preselected distance apart and are adapted to receive an end portion 182 of a stop pin generally designated by the numeral 184 in FIGS. 1, 3 and 9. Each stop pin 184 is secured in a bore 180 by means such as the engagement of a set screw (not shown) extending through the threaded bore 186. A representative number of the bores 186 is shown in FIG. 7, and it should be understood that each bore 180 communicates with a means of securing each stop pin 184, such as with the set screw bore 186.

Each pin 184 has an opposite end portion 188 which is formed at a preselected angle "b", as illustrated in FIG. 9. Also, FIG. 9 illustrates that the pins 184 are different in length, "a" corresponding to a desired character size formed by the impact pins 130. With this arrangement, as illustrated in FIG. 6, the piston cylinder assembly 142 is actuated to retract the cylinder rod 148 to pivot the manifold block 134 about the pivot pin 136. The indexing wheel 166 rotates freely when the stop plug 162 is removed from abutting relation with the stop pin 184.

The indexing wheel 166 is then rotated by the indexing motor 172 to position the desired stop pin 184 opposite the stop plug 162 on the manifold block end portion 158. When the desired pin 184 is in position oppositely of the stop plug 162, the piston cylinder assembly 142 is again actuated to extend the cylinder rod 148. This pivots the manifold block 134 about the pivot pin 136. The manifold block, together with the marking head body 128, pivots until the stop plug 162 abuts the end of the stop pin 184, as shown in FIG. 6.

Further in accordance with the present invention, it is the angled position of the manifold block 134 and the marking head body 128 which determine the size of the dot matrix characters formed by contact of the impact pins 130 with the surface of the workpiece. Thus the height of the characters is determined by the pivoted angle "b" of the manifold block 134 about the pivot pin 136. Accordingly, the pivoted position of the manifold block 134 is determined by the relative extension of the cylinder rod 148. The length of extension of the cylinder rod 148 is, in turn, determined by the point at which the manifold block 134 pivots until further pivotal movement is obstructed by contact of a stop pin 184 of the indexing wheel 166 with the stop plug 162.

By providing a plurality of stop pins 184 having a range of lengths, the pivoted angle of the manifold block 134 for a preselected character size is precisely controlled. The character size is therefore directly related to the length "a" shown in FIG. 9 of each stop pin 184. Further in accordance with the present invention, the length of each stop pin 184 positioned in a bore 180 of the indexing wheel 166 is different.

A representative example of the relationship between character size as determined by the length of the stop pin 184 is shown in the chart of FIG. 11. For example, for a dot matrix character having a height of ½ inch, the length "a" of the pin 184 is 1⅛ inches. Accordingly, by way of further example, a character size of ⅜ inch requires a stop pin of 1¼ inches, and so on as enumerated in FIG. 11.

To assure positive stop of the pivotal movement of the manifold block 134 by contact of the pin end portion 188 with the stop plug 162, the end portion 188 is angled at a preselected degree "b". Accordingly the magnitude of the angle "b" varies with the length of the pin 184. The chart in FIG. 11 also indentifies the magnitude of the angle "b" for each respective length "a" of the pin 184. In accordance with the present invention, dimensions "a" and "b" are selective and are also determined by the pivotal location of the manifold block 134 on the plate 62.

Further in accordance with the present invention, the indexing motor 172 can be remotely controlled. It is also programmable to rotate the indexing wheel 166 to the desired location for positioning a pin 184 of the required length for a selected dot matrix character size.

Now referring to FIGS. 12–17, there is illustrated in greater detail the elements of the marking device 14 which, as discussed above, include the marking head body 128 with the impact pins 130 and the manifold block 134 with the solenoid valves 132 for controlling movement of the pins 130. Referring to FIG. 12, there is illustrated the internal structure of the marking head body 128 including a plurality of impact pins 130, for example nine impact pins, positioned in bores 190 equally spaced apart in the marking head body 128.

Figure 13:
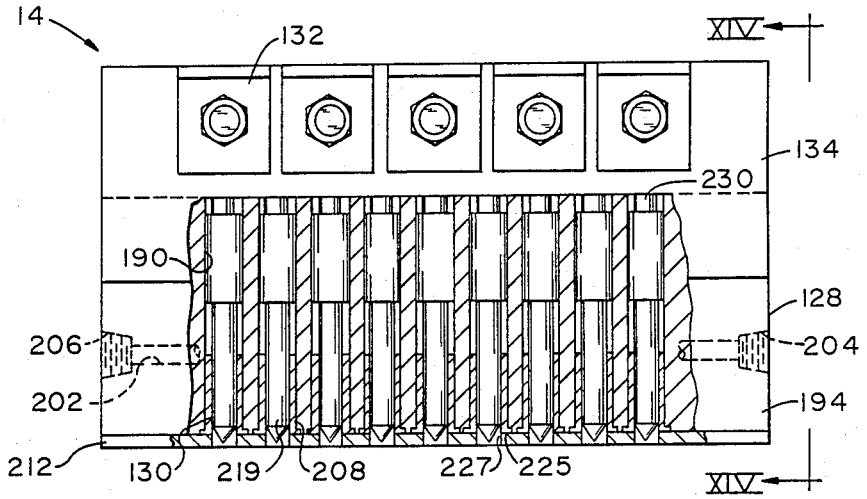
FIG. 13 is an enlarged view in side elevation and partially in section of the marking head assembly, illustrating a plurality of marking pins that are selectively extended and retracted from the assembly to form a selected dot matrix character on the surface of the workpiece.

Each of the bores 190 extends completely through the body 128 from an air inlet end portion 192 to a pin outlet end portion 194. As illustrated in FIG. 13, the length of the manifold block 134 corresponds to the length of the head body portion 128. Adjacent the air inlet end portion 192 of the head body 128 are provided bores 196 that extend transversely through the head body portion 128 in a manner not passing thorugh the bores 190 for the pins 130.

The manifold block 134 includes a recessed portion 198 at one end portion thereof for receiving the air inlet end portion 192 of the head body 128. A pair of bores 200 extends through the depending shoulder of the manifold block 134 in alignment with the bores 196 of the head body 128. Accordingly, a pair of quick release pins (not shown) extends through two pairs of aligned bores 196 and 200 to connect the head body 128 to the manifold block 134. The connecting pins have been omitted in FIGS. 14 and 15 for clarity of illustration of the bores 196 and 200, and it should be understood that types of connections are to be utilized to permit efficient connection of the marking head body 128 to the manifold 134.

Figure 14:
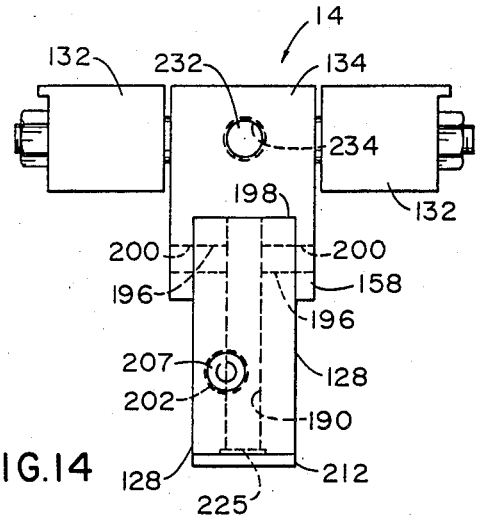
FIG. 14 is a view of the marking head assembly taken along XIV—XIV of FIG. 13.

Each of the impact pins 130 as shown in FIG. 13 are reciprocally movable within the bores 190, and the manner in which the pins 130 are positioned is schematically illustrated in FIG. 15. The marking head body 128, as illustrated in FIGS. 12–15, includes an air passageway 202 which extends entirely through the head body 128 in a manner such that a portion of passageway 202 passes through the bores 190. The passageawy end portions 204 and 206 are drilled and tapped to receive a pipe tap 207 as shown in FIG. 14 for receiving a connection to a source of air under pressure.

As illustrated in FIGS. 12, 13 and 15, a pin guide or bushing 208 is positioned in each bore 190 below the passageway 202. The bushing 208 serves to maintain the end of the pin 130 movable in a straight line path into and out of contact with the schematically illustrated workpiece 210. Furthermore, a portion of the air passageway 202 passes through the upper end portions of each pin guide 208. The bushing 208 is retained in the bores 190, for example as illustrated in FIGS. 13, 14 and 15, by a face plate 212 which is bolted to the bottom of the marking head body 128. Other methods may also be utilized.

One embodiment of pin 130 is illustrated in FIG. 16 which includes a bushing 214. The bushing 214 has three different sized bores. The first bore 215 is drilled and tapped to accommodate a pipe plug or set screw 216. The second bore 217 is below bore 215 and is of such diameter to accommodate the enlarged headed end portion 220 of pin shaft portion 219. The third bore 221 is below bore 217 and is the same diameter of the pin shaft body portion. By bore 221 being of a smaller diameter than bore 217, a ledge portion 222 is formed in bushing 214. Pin 130 is assembled by dropping the pin shaft portion 219 through bore 221 until the face 223 of the enlarged head portion 220 of the pin shaft 219 abuts ledge portion 222. The spacer 218 is then inserted to fill bore 221. With the spacer 218 in place, the set screw 216 is then threadedly advanced into the upper threaded portion of bore 215 to maintain the relative parts of pin 130 in an assembled fixed relation.

Another embodiment of the pin 130 is illustrated in FIG. 17 which includes a bushing 224 having a length shorter than the bushing 214 shown in FIG. 16. The bushing 224 is also positioned on a headed end 226 of pin 130 and a set screw 216 is advanced into threaded engagement with the bushing 224 until the set screw 216 abuts the headed end 226. With this arrangement, the above described spacer 218, shown in FIG. 16, is omitted, thereby reducing the overall length of the pin 130.

The length of the impact pin can be adjusted, that is used with or without a spacer in the pin bushing. Further adjustments can be made in the diameter and weight of the pin 130 which, in turn, controls the size of the dot forming the dot matrix character by increasing or decreasing the size and downward thrust of the pin 130.

The marking head body 128 is not limited to a pin of a preselected diameter or a preselected length and various pin sizes can be utilized, depending upon the dimensions of the dot matrix character to be formed. This may be accomplished by inserting into the pin outlet end portion 194 of the marking head body 128 the appropriate bushing 208 which has a fixed outside diameter 225 equal to that of bore 190 and an inside diameter 227 equal to the desired diameter of pin shaft portion 219 of pin 130. Depending on the desired size of the dot forming the dot matrix character, the pin size and thrust may need to be varied.

The pin thrust may be increased by increasing the downward force on pin 130. Moreover, it may also be increased by the utilization of a larger pin 130. If the latter is desired, the bushing 214 of pin 130 is elongated, as illustrated in FIG. 16. In order to keep the top end portion of set screw 216 even with the top end portion of bushing 214, a spacer 218 of the appropriate length is inserted into bore 217 so as to firmly abut the head portion 220 of pin shaft 219 and the base portion of set screw 216 when the set screw 216 is threadedly advanced into the upper threaded portion of bushing bore 215.

As schematically illustrated in FIG. 15, the pin 130 is extendable from an retractable into the bore 190 of the marking head body 128. Downward movement of the pin 130 is initiated by the flow of air under pressure through a passageway 230 in the manifold 134. The passageway 230 communicates with the bore 190 at the upper end of the pin 130. Flow of air against the set screw 216 of the pin 130 moves the pin downwardly through the head body 128 into contact with the workpiece 210 to thereby indent the surface of the workpiece 210 with a dot forming part of the desired dot matrix character. An air inlet passageway 230 communictes with each bore 190 in the marking head body 128.

The opposite end of the air passage 230 communicates with a solenoid valve 132 that is mounted to the manifold block 134. Accordingly, each air passage 230 connects one of the respective pin bores 190 with a solenoid valve 132. Therefore, as illustrated in FIG. 12, for a marking head body 128 having a nine pin arrangement, nine solenoid valves 132 are utilized. The valves 132 are spaced from one another on opposite sides of the manifold block 134 as shown in FIGS. 12, 14 and 15.

The manifold block 134 includes a passageway 232 that extends the full length of the block 134. The passageway 232 also includes open end portions 234 which are adapted to receive a pipe tap (not shown) similar to the above described pipe tap 207. With the arrangement, the passageway 232 is connected to a source of air under pressure. The passageway 232 extending through the manifold block 134 communicates with a plurality of passageways 236 for connecting each solenoid valve 132 to the air passageway 232. A pair of connecting passageways 236 are illustrated for the corresponding pair of solenoid valves 132 in FIG. 15.

Thus with the above described arrangement, air under pressure is directed into the manifold block 134 through one of the end portions 234 of the passageway 232, and the air flows along the passageway 232 through the connecting passageways 236 to the solenoid valve 132. The solenoid valves 132 are operable to control the flow of air through the corresponding passageway 236 and into the bore 190 of the respective pin 130. Thus, the solenoids 132 function as energizing means for the respective pins 130.

Upon actuation of a solenoid valve 132, air is introduced into the passageway 230 and directed against the end of the pin 130 to force the impact end portion of the pin 130 beyond the face plate 212 into impact relation with the workpiece 210. The pins are normally maintained in a retracted position within the bore 20 by a constant flow of air under pressure through the passageway 202, which is in communication with all of the bores 190. The flow of air through the passageway 202 into the bores 90 acts against the lower end of the bushing 214 to force the bushing upwardly into contact with the manifold block 134 in the recess 198.

The pressure of the air flowing through the passage 202 is less than the pressure of the air directed from the respective solenoids 132 against the upper end of the pin 130. Upon actuation of a solenoid 132, the pin 130 will overcome the resistance provided by the air through the passageway 202 and extend into impact relation with the workpiece 210. In the event the lower end of the bushing 214 comes in contact with the upper end of the bushing 208 upon extension of the pin 130, air from the passageway 202 is still capable of extending the bore 190 to act against the pin 130 to retract the pin 130 when the respective solenoid 132 is deenergized. Deenergizing a solenoid 132 cuts off the flow of air through the passageway 230. The flow of air through the passageway 202 then acts against the bushing 214 to retract the pin 130 into the marking head body 128. Thus, by controlling the operation of the solenoids 132, the impact pins 130 are extended and retracted in a controlled manner to indent the surface of the workpiece 210 with dots to form a single line, dot matrix array of characters.

The apparatus for selecting the dot matrix array of characters to be formed by the pins 130 impacting the surface of the workpiece is located at an operator's terminal, which is connected to a computer operated controller. From the controller, the characters to be inscribed on the workpiece are selected and the selection is made from a data entry terminal which is located remote from the location of the marking apparatus. The controller generates data and character signals which are transmitted to solenoid valves 132.

The sequence operation of the solenoid valves 132 to extend and retract the impact pins 130 is controlled by a speed sensor device, such as an encoder 238 associated with the ball screw 86, as illustrated in FIGS. 2 and 4. The encoder 238 is responsive to the rate of rotation of the ball screw 86 which is adjustable by operation of the motor 64. The encoder 238 monitors or senses the rate of rotation of the ball screw 86 and generates responsive signals, known as tach pulses. The tach pulses are directly proportional to the rate of rotation of the ball screw 86 and are transmitted as feedback signals to the controller. The controller processes the feedback signals to sequence the operation of the solenoid valves 132 for a preselected rate of impact of the pins 130 with the workpiece. Accordingly, the rate of impact is adjustable.

The feedback signals generated by the encoder 238 upon rotation of the ball screw 86 are transmitted in a desired format to a controller. The feedback signals are processed for transmitting corresponding signals for sequencing the opening and closing of the solenoid valves 132 to maintain a desired width of the characters. With the above described arrangement, the encoder 238 sequences actuation of the solenoid valves 132 for imprinting a single line of characters on the surface of the object to be marked.

Figure 18:
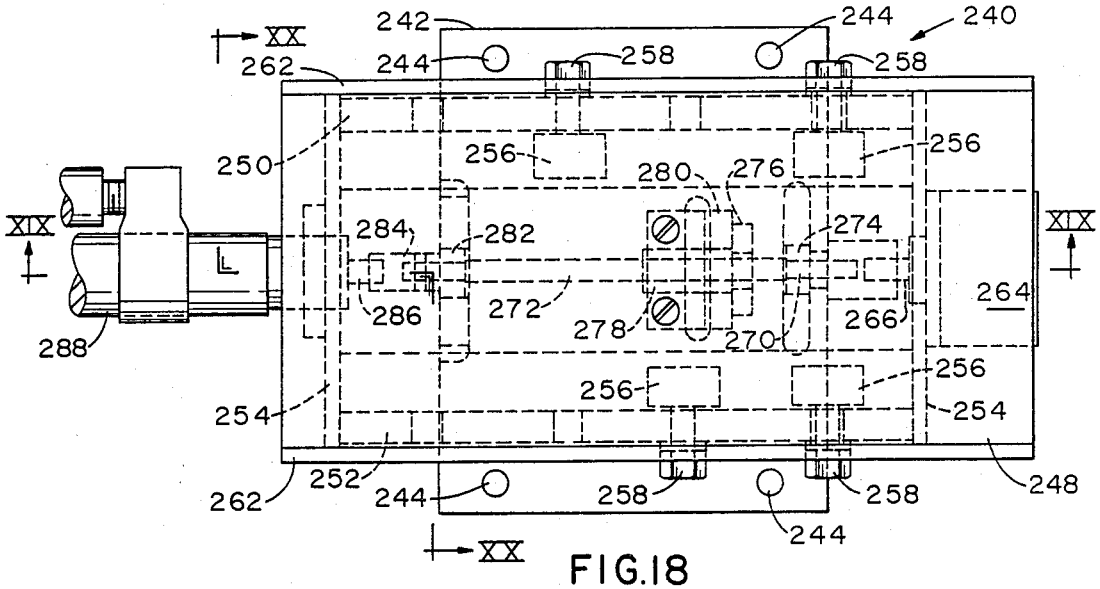
FIG. 18 is a top plan view of a table assembly for movably supporting a workpiece relative to the marking machine of the present invention for multiple line marking.
Figure 19:
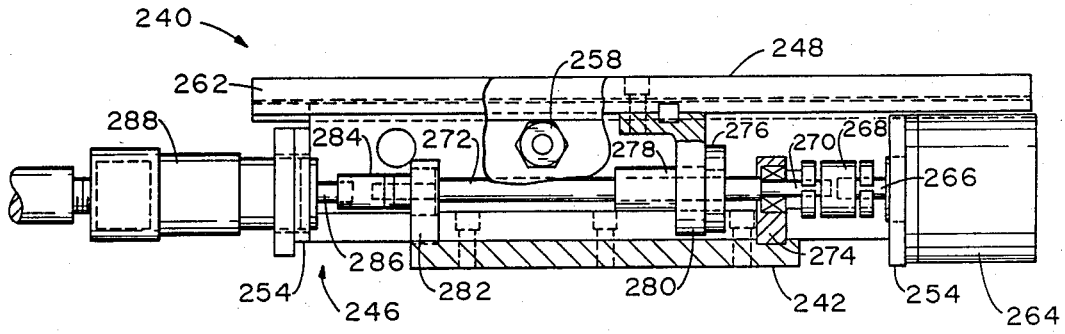
FIG. 19 is a fragmentary view, partially in section, of the table assembly taken along line XIX—XIX of FIG. 18.
Figure 20:
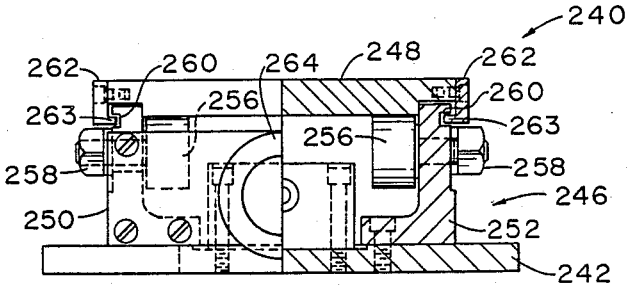
FIG. 20 is a further view, partially in section, of the table assembly, taken along line XX—XX of FIG. 18.

Further in accordance with the present invention, the marking apparatus 10 illustrated in FIG. 1 is adaptable for multiple line marking of an object by utilizing a movable table assembly generally designed by the numeral 240 in FIGS. 18–20. The table assembly 240, in order to perform multiple line marking of a workpiece, is positioned on the platform 26, shown in FIG. 1, beneath the marking device 14. The object to be marked is positioned on the table assembly 240. The table assembly 240 oscillates the object in a controlled manner beneath the marking device 14 to permit multiple line marking. As illustrated in FIGS. 18–20, the movable table assembly 240 includes a base plate 242 which is adapted to be bolted in a fixed position to the surface 28 of the platform 26, illustrated in FIG. 1. As seen in FIG. 18, a plurality of holes 244 are provided for receiving bolts for engagement with the platform 26. In this manner, the base plate 242 of the assembly 240 is rigidly secured on the platform 26.

A frame generally designated by the numeral 246 is attached to the base plate 242 for supporting a movable upper plate 248. The frame 246 is formed by a pair of longitudinally spaced angle brackets 250 and 252, as illustrated in FIG. 20. The angle brackets 250 and 252 have a length corresponding substantially to the length of the upper plate 248. The angle brackets are transversely connected to one another by side plates 254 secured to the ends of the angle brackets 250 and 252.

As seen in FIGS. 18 and 20, a plurality of rollers 256 are connected by bolts 258 to the angle brackets 250 and 252 in underlying, supporting relation with the upper plate 248. To also facilitate slidable movement of the upper plate 248 on the frame 246, the upper end portions of the brackets 250 and 252 are provided with longitudinally extending channels 260, as illustrated in FIG. 20. The upper plate 248 includes downwardly depending side plates 262 having lower end portions 263 which are received and are movable in the channels 260. With this arrangement, the upper plate 248 is securely positioned for reciprocal movement on the frame 246 which is secured to the base plate 242 which is, in turn, affixed to plateform 26.

Longitudinal movement of the upper plate 248 on the upper edges of the angle brackets 250 and 252 is initiated by a motor 264 which can be either electrically or pneumatically operated. The motor 264 includes an output shaft 266 drivingly connected by a coupling 268 to drive shaft portion 270 of a ball screw 272. The drive shaft portion 270 is rotatably supported by a bearing bracket 274 which is mounted on the base plate 242. The ball screw 272 extends through a shaft seal 276. A ball screw guide 278 is drivingly connected to the ball screw 272. The ball screw guide 278 is, in turn, connected by an angle bracket 280 to the lower surface of the upper movable plate 248. The opposite end of the ball screw 272 is rotatably supported by a bearing bracket 282 similar to the bearing bracket 274. The bracket 282 is mounted on the base plate 242. The opposite end of the ball screw 272 is connected by a coupling 284 to the drive shaft 286 of an encoder 288.

With this arrangement, actuation of the motor 264 to rotate the drive shaft 266 in a preselected direction, rotates the ball screw 272 in a corresponding direction. As the ball screw 272 rotates, the ball screw guide 278 moves longitudinally on the ball screw 272 to move the upper plate 248 connected by the bracket 280 to the guide 278 in a corresponding direction. As seen in FIG. 20, the upper plate 248 is movable in a horizontal plane. Accordingly, changing the direction of rotation of the ball screw 272 changes the direction of movement of the plate 248 on the upper surfaces of the angle brackets 250 and 252.

The encoder 288 illustrated in FIGS. 18 and 19 operates in a manner similar to the encoder 238, as above described. The encoder 288 monitors the rate of rotation of the ball screw 272 for reciprocating the movable plate 248. As discussed above, the object to be marked is secured in a fixed position to the surface of the plate 248. Thereafter, the table 248 is moved to a desired position to locate the workpiece in underlying relation with the marking device 14 for initiating the marking of a line of characters at a preselected location on the workpiece. The line of characters to be marked is entered into the memory of the computer which controls the operation of the apparatus 10 so that during the marking of the workpiece, the plate 248 is stationary.

Upon completion of a line of marking, the operation of the solenoid valves 132 and ball screw 86 is terminated. Upon this occurrence, rotation of the ball screw 272 in a preselected direction is initiated by action of the motor 264. Accordingly, the ball screw 272 is rotated through a preselected number of revolutions to advance the plate a preselected distance for the desired spacing between the next successive line of characters to be marked from the previously marked line. The encoder 288 monitors the rotation of the ball screw 272 and transmits tach pulses that form the feedback signals to the controller.

The tach pulses are proportional to the range of movement of the table 248 from an initial starting point so that once the plate 148 has moved a sufficient distance to obtain the desired spacing between the line of characters, the feedback signals to the controller are processed. When the table is advanced the programmed distance, as indicated by the feedback signals from the encoder 288, rotation of the ball screw 272 by operation of the motor 264 is interrupted. Thereafter, the controller activates the motor 64 and the solenoid valves 132 for a preselected rate of impact of the pins 130 with the surface of the object on the plate 248 for inscribing the next line of characters spaced a set distance from the previously marked line of characters.

It should be understood that the marking device 14 is operable for marking in a forward, as well as a reverse direction of movement, so that marking of the workpiece is not limited to marking in one direction. In this manner, bidirectional marking of an object is accomplished to substantially increase the speed of marking, particularly for multiple line marking. Accordingly, the characters from one line to the next may vary in height, as determined by operation of the pivoting mechanism 126 and indexing wheel 166 above described. the successive operation of advancing the table 248 a given distance, commencing operation of the solenoid valves 132 and motor 64, and terminating the operation of the valves 132 and motor 64 to again advance the table a set distance can be repeated for multiple line marking of the workpiece on the movable plate 248.

According to the provisions of the patent statutes, I have explained the principle, preferred constrution and mode of operation of my invention and have illustrated and described what I now consider to represent its best embodiments. However, it should be understood that, within the scope of the appended claims, the invention may be practiced otherwise than an specifically illustrated and described.

I claim:

1. Apparatus for impressing a preselected mark on the surface of an object comprising, a marking head having a body portion, said body portion including a spaced apart arrangement of bores extending therethrough, said body portion including a first surface and a second surface positioned oppositely of said first surface, said bores extending through said first and second surfaces, a marking element reciprocally positioned in each of said bores, each of said marking elements including a shaft portion with an impact end portion movable into and out of said respective bore from said body portion first surface to impress a mark on the surface of an object, said marking element having an opposite end portion positioned in said bore adjacent said body portion second surface, a manifold block having side walls and a bottom wall, said manifold block positioned in abutting relation with said marking head body portion second surface, means for connecting said manifold block to said marking head body portion, said manifold block having a longitudinal passageway therein actuating means carried by said manifold bock and communicating with each of said marking elements for sequentially reciprocating said marking elements in said bores in a controlled manner to impact the object and impress a preselected mark on the surface of the object, and said manifold block having transverse passageways, certain of said transverse passageways connected to said longitudinal passageway and said actuating means to supply air under pressure to said actuating means, other of said transverse passageways connected to said actuating means and said bores to supply air under pressure from said actuating means to said respective bores.

2. Apparatus as set forth in claim 1 in which, said marking element includes a pin member reciprocally positioned in said bore, and said pin member including a striking end portion being movable between a first position within said body portion retracted from said first surface and a second position extending a preselected distance from said first surface.

3. Apparatus as set forth in claim 1 which includes, means for adjusting the position of said marking element in said bore to control the length of the marking element movable out of said bore into contact with the object.

4. Apparatus as set forth in claim 1 which includes, means positioned in said bore for maintaining straight line reciprocal movement of said marking element impact end into and out of contact with the object.

5. Apparatus as set forth in claim 1 in which, said actuating means includes a plurality of solenoid valves individually communicating with said respective bores for introducing pressurized air thereto for extending said marking elements into impact relation with the object to be marked.

6. Apparatus as set forth in claim 1 which includes, conduit means positioned in said marking head for connecting in fluid communication said bores with a source of pressurized fluid to maintain said marking elements in a retracted position in said bores, and means for stabilizing said marking elements in a retracted position in said bores.

7. Apparatus as set forth in claim 1 in which, said manifold bottom wall has a recessed portion with a surface in abutting relation with said body portion second surface, said manifold having depending shoulder portions abutting said body portion side walls, said manifold depending shoulders and said body portion having aligned bores, pin means extending through said aligned bores to secure said manifold to said body portion.

* * * * *